US007771221B1

(12) United States Patent
Blackwell

(10) Patent No.: US 7,771,221 B1
(45) Date of Patent: Aug. 10, 2010

(54) ENVIRONMENTAL PROTECTIVE COVERING FOR ELECTRICAL POWER CONNECTORS

(76) Inventor: Donald A. Blackwell, 19534 Vineyard La., Saratoga, CA (US) 95070-4556

( * ) Notice: Subject to any disclaimer, the term of this patent is extended or adjusted under 35 U.S.C. 154(b) by 0 days.

(21) Appl. No.: 12/567,772

(22) Filed: Sep. 27, 2009

(51) Int. Cl.
*H01R 13/52* (2006.01)

(52) U.S. Cl. ..... 439/282

(58) Field of Classification Search ..... 439/281, 439/282, 588, 278, 604, 551, 559, 279
See application file for complete search history.

(56) References Cited

U.S. PATENT DOCUMENTS 2,552,686 A * 5/1951 Melcher ..... 174/153 R
2,786,359 A * 3/1957 Karlan et al. ..... 403/50
3,685,006 A * 8/1972 Jerrold-Jones ..... 439/582
4,192,566 A * 3/1980 Laudig et al. ..... 439/290
4,284,321 A * 8/1981 Detemple et al. ..... 439/581
5,199,893 A * 4/1993 Fussell ..... 439/271
5,857,873 A * 1/1999 Castaldo ..... 439/588
5,885,104 A * 3/1999 Foster et al. ..... 439/580
7,220,137 B1 * 5/2007 Liu ..... 439/136
7,364,469 B2 * 4/2008 Huffman et al. ..... 439/675
7,407,412 B2 * 8/2008 Khemakhem ..... 439/578
2006/0178028 A1 * 8/2006 Swiatek et al. ..... 439/215
2008/0318469 A1 * 12/2008 Paglia et al. ..... 439/578

* cited by examiner

*Primary Examiner*—Phuong K Dinh

(57) ABSTRACT

Environmental protection methods for power connectors normally suited only for indoor use that allows said connectors to be used in the harsh outdoor environment of powersports vehicles such as motorcycles, all terrain vehicles, snowmobiles and other special purpose vehicles. The resulting environmentally protected low power connectors provide a small, lightweight, easy to mount, low-cost power source for a wide variety of low power accessories.

4 Claims, 6 Drawing Sheets

ENVIRONMENTAL PROTECTIVE COVERING FOR ELECTRICAL POWER CONNECTORS

FIELD OF INVENTION

This invention relates to electrical power connectors for motorcycles, all terrain vehicles, snowmobiles and other vehicle commonly referred to as powersports vehicles and also but not limited to other special purpose vehicle such as golf carts and powered wheel chairs.

BACKGROUND OF INVENTION

Owners and users of motorcycles, all terrain vehicles, snowmobiles, commonly called powersports vehicles and other special purpose vehicles such as golf carts and powered wheel chairs are frequently modified from their original equipment manufactured configuration to add a variety of accessories that enhance the vehicle capability and the operator's experience. These added accessories may be roughly divided into three categories: low power up to 2 amp or 20 watts, medium power of 2 to 5 amps or 20 to 60 watts and high power of 6 amps or 80 watts and greater. Examples of low power accessories may include navigation systems such as global positioning systems, cell phones, entertainment systems, radar detectors, intra-vehicle rider to passenger communication systems, inter-vehicle short range communication systems, personal digital assistants and small computers. Medium power accessories may include on-road auxiliary lighting and single articles of heated clothing. High power devices may include high intensity off-road lighting, external battery chargers and multiple articles of heated clothing.

A search of available vehicle accessories shows that there exist many more types of low power accessories than medium or high power accessories. Moreover, low power accessories are commonly able to be easily removed from the vehicle for personal use. For example a cell phone is normally carried on the person but can be mounted in a quick detach cradle on a vehicle for hands-free use. High power accessories are more commonly attached more permanently on the vehicle. For example high power off road lights must be mounted rigidly to ensure proper beam aiming and require special purpose wiring capable of carrying high current.

In spite of the fact that most accessories fall into the low power category, the availability of power connectors with convenient vehicle mounting methods, quick detach capability and sized for low power are non-existent in the market. Currently available accessory power connectors include DIN ISO 4165 jack/plug connector pairs, SAE two pin male/female connector pairs and cigar lighter sockets. These connector/socket systems are capable of carrying as much as 10 to 20 amps or ten times the required power levels of low power accessories. These large connectors may be acceptable for connecting low power accessories in automobiles and trucks that have large passenger compartments where space is not an issue. However, they are not well suited to the aforementioned powersports vehicles that have very limited mounting space. Moreover, some connectors such as the DIN ISO 4165 type and cigar lighters have marginal or no environmental sealing when the connection is made. Lastly, these large connectors typically require heavy mounting methods such as thick metal brackets or bulky screw clamps.

There exists readily available compact, lightweight, low voltage coaxial barrel jack/plug type connector that are commonly used to power home and office electronics. Said coaxial barrel connectors would be suitable for powersports and specialty vehicle use were it not for the fact that they are designed for indoor use and have neither environmental protection nor any mounting apparatus. Both of these connector types are typically available as free-hanging cable connectors, printed circuit board mounted or as panel mounted devices for use in electrical equipment cabinets and chassis. While these configurations have been adapted to vehicle use, the results can be unsightly, awkward, and prone to environmental damage and in some cases unsafe.

The primary object of this invention is to provide the owners and users of powersports vehicles and specialty vehicles environmental protection that allow the utilization of readily available, compact coaxial barrel connector.

SUMMARY OF THE INVENTION

To achieve the above objectives, and in accordance with the purpose of the invention broadly described herein firstly, an encapsulation for coaxial barrel connectors comprising of: an encapsulated coaxial barrel socket with an external sealing feature protruding from and encircling the mating end of the coaxial barrel socket, a corresponding environmentally protected coaxial barrel plug with an internal intrusive sealing feature shaped to fit snugly against the sealing feature of the coaxial barrel socket thus providing environmental protection.

The encapsulation may be made from any resilient, weather resistant material such as synthetic rubber or a thermoplastic elastomer. The material may be of different colors for different axial barrel connector pairs to allow the user to distinguish between different power connections such as direct battery connection, ignition switched connection or auxiliary switched connection.

The sealing feature of the coaxial barrel socket or coaxial barrel plug or both the coaxial barrel socket and coaxial plug may be integrally formed with the encapsulation or be comprised of separate parts as will be described herein.

The encapsulated coaxial barrel socket or plug may be formed as a linear cylinder, right angle or some intermediate angle to provide the user options for efficient cable routing.

Secondly the present invention describes a cap with a restraining lanyard that provides environmental protection for the coaxial barrel socket when a coaxial barrel plug connection is not present. The protective cap is so formed as to provide the same intrusive sealing feature as described for the coaxial barrel plug.

DETAILED DESCRIPTION OF THE INVENTION

Reference will now be made in detail to the present embodiments of the invention as illustrated in the accompanying figures. It should be noted that no reference is made to the cabling or vehicle connections as these connections are common vehicle power and ground cables and are well known to anyone skilled in the art. In addition, strain relief features are shown on all cables but are not included as numbered items as they are common to power cables, well documented by prior art and thoroughly understood by anyone skilled in the art.

Figure 1:
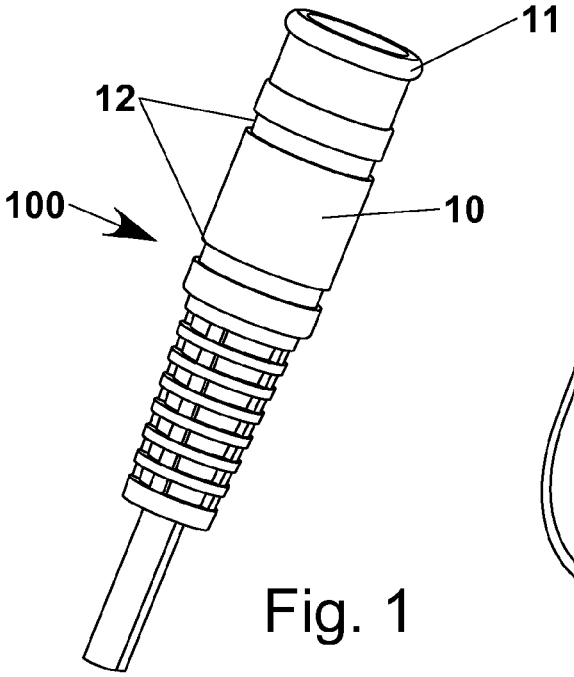
FIG. 1 shows a coaxial barrel jack with environmental protective encapsulation to form an environmentally protected coaxial barrel jack.

FIG. 1 shows the basic building block of the connector system, an environmentally protected coaxial barrel jack 100 with a coaxial barrel jack encapsulation 10 made of a resilient weather resistant material such as such as synthetic rubber or thermoplastic elastomer (TPE). Said encapsulation 10 is shown as having a generally rounded section but other shapes such as hexagonal, elliptical or a combination of shapes could be employed. Said coaxial barrel jack encapsulation 10 includes a sealing lip 11 oriented circumferentially about the end most part of the body. Said sealing lip 11 shown has a generally round cross section profile for ease of mating and de-mating the corresponding connector but other shapes are possible as well. The coaxial barrel jack encapsulation 10 may have two fixing radial grooves 12 to provide a more robust locating function for the fixing parts that will be described later.

Figure 2:
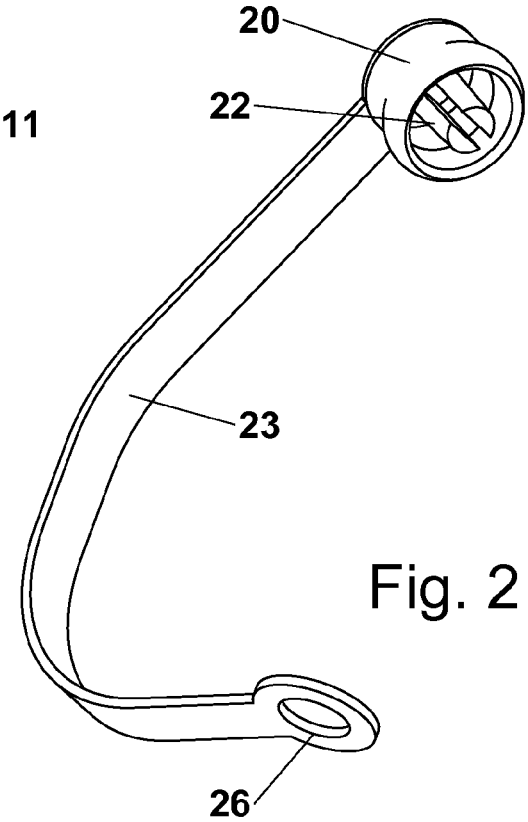
FIG. 2 shows an embodiment of an environmental protective cap with integral lanyard that mates with the environmentally protected coaxial barrel jack of FIG. 1 to provide an environmental seal when the environmentally protected coaxial barrel jack is not mated with an environmentally protected coaxial barrel plug.

FIG. 2 illustrates an embodiment of a protective cap 25 made of a resilient weather resistant material such as such as synthetic rubber or thermoplastic elastomer (TPE). Said protective cap consists of a molded hat section ring 20 with an integrally molded internal radial sealing element 21 that is shaped to mate with the sealing lip 11 of the coaxial barrel jack encapsulation 10. Said hat section ring 20 may also include a protruding cylindrical plug 22 to aid the guiding of said hat section ring 20 onto coaxial barrel jack encapsulation 10. Said hat section ring 20 also includes a lanyard 23 which is preferably molded integrally with said hat section ring 20 and terminating in an integral attachment ring 24. Said attachment ring 24 is sized to fit freely over the protruding cable of the environmentally protected coaxial barrel jack 100 so as to be retained securely to the environmentally protected coaxial barrel jack 100.

Figure 3:
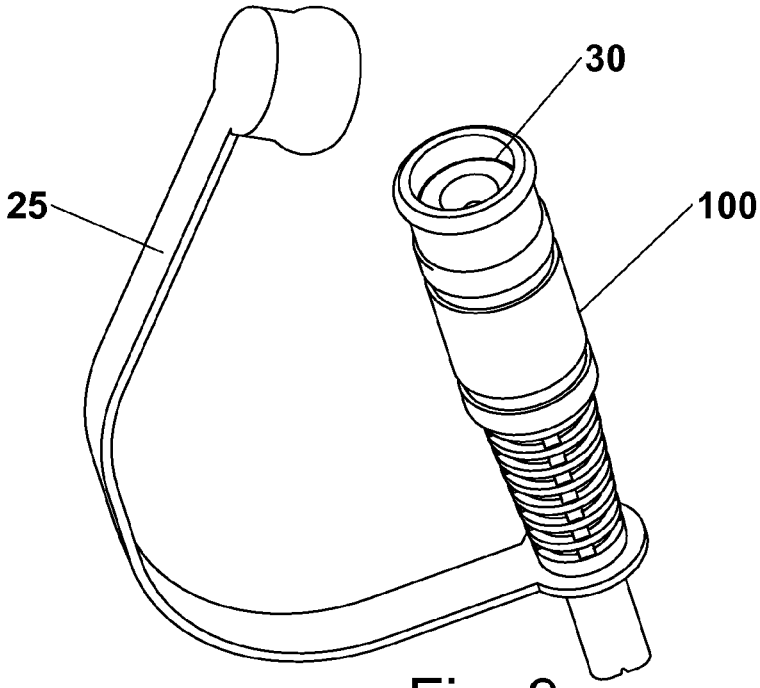
FIG. 3 shows the environmentally protected coaxial barrel jack of FIG. 1 mated with the environmental protective cap of FIG. 2.

FIG. 3 shows the assembly of the environmentally protected coaxial barrel jack 100 and the protective cap 25. This figure also illustrates the position of the coaxial barrel jack 30 within the encapsulation 10.

Figure 4:
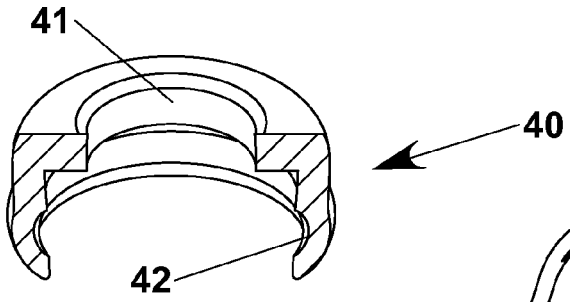
FIG. 4 shows an embodiment of an environmentally protected coaxial barrel plug sealing cap molded as a separate part.

FIG. 4 shows an embodiment of a external seal ring 40 made of a resilient weather resistant material such as such as synthetic rubber or thermoplastic elastomer (TPE) generally shaped in a hat configuration. Said external seal ring 40 provides the environmental protective function for all configurations of the environmentally protected coaxial barrel plugs that will be described herein. Said external seal ring 40 includes an intrusive radial seal groove 41 located at its lower edge, shaped to mate with the sealing lip 11 of encapsulation 10. Said sealing cap 40 also includes a circular opening 42 at the top of the hat section to provide a securing feature to position the seal cap on the environmentally protected coaxial barrel plug to be described in later paragraphs.

Figure 5A:
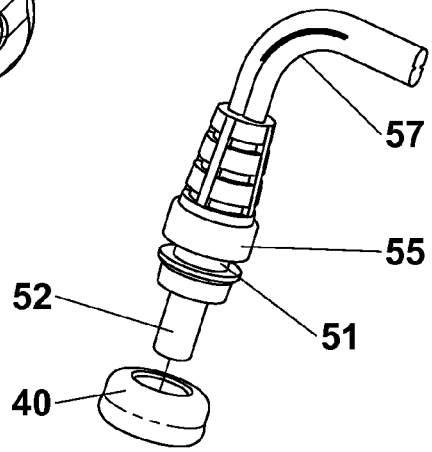
FIGS. 5A and 5B show an exploded view and assembled view of an embodiment of an environmentally protected coaxial barrel plug with the seal cap shown in FIG. 4.

FIG. 5A shows an exploded view of an embodiment of an environmentally protected coaxial barrel plug 50 consisting of a coaxial barrel plug 52 with an coaxial barrel plug encapsulation 55 made of a resilient weather resistant material such as such as synthetic rubber or thermoplastic elastomer (TPE). Said coaxial barrel plug encapsulation 55 is shown as having a generally rounded cylindrical section but other shapes such as hexagonal, elliptical or a combination of shapes could be employed. Said coaxial barrel plug encapsulation 55 includes a radial capture groove 51 oriented circumferentially about the end most part of the body into which the external seal ring 40 is fit. The coaxial barrel plug 52 protrudes from said coaxial barrel plug encapsulation 55 in a coaxial alignment with the coaxial barrel plug encapsulation 55 and two conductor cable 57 so as to extend past the external seal ring 40.

Figure 5B:
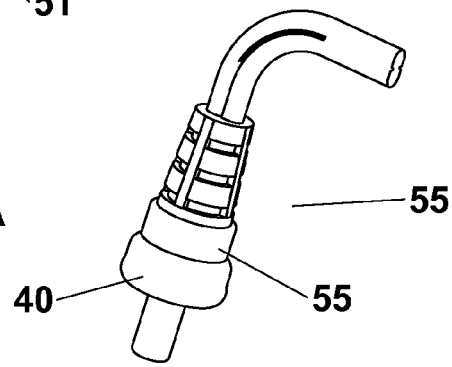

FIG. 5B shows an assembled view of the environmentally protected coaxial barrel plug 50 with coaxial barrel plug 52, coaxial barrel plug encapsulation 55, two-conductor cable 57 and external seal ring 40 arranged as a vertical assembly.

Figure 6A:
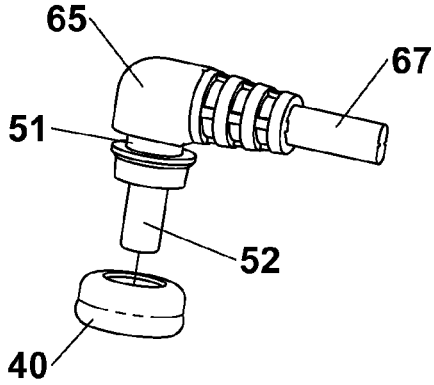
FIGS. 6A and 6B show an exploded view and assembled view of an embodiment of an environmentally protected coaxial barrel plug with a right angle configuration and sealing cap.

FIG. 6A shows an exploded view of an embodiment of a right angle environmentally protected coaxial barrel jack 60 consisting of a coaxial barrel plug 52 with an right angle coaxial barrel jack encapsulation 65 made of a resilient weather resistant material such as such as synthetic rubber or thermoplastic elastomer (TPE). Said encapsulation 65 is shown as having the generally shape of a truncated obround but other shapes such as hexagonal, elliptical or a combination of shapes could be employed. Said encapsulation 65 includes the radial capture groove 51 oriented circumferentially about the end most part of the body into which the external seal ring 40 is fit. The coaxial barrel plug 52 protrudes from said encapsulation 65 in a right angle alignment with the encapsulation 65 and two-conductor right angle cable 67 so as to extend past the external seal ring 40.

Figure 6B:
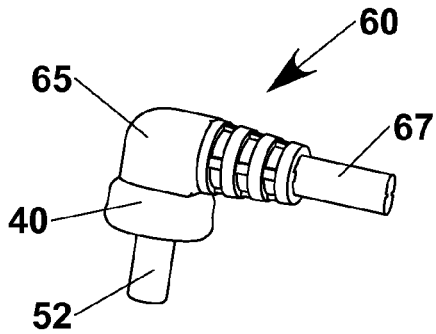

FIG. 6B shows an assembled view of the right angle environmentally protected coaxial barrel jack 60 with coaxial barrel plug 52, encapsulation 65, cable 67 and external seal ring 40 arranged as a right angle assembly.

All embodiments described herein show the external seal ring 40 as a separate part as this embodiment provides the greatest versatility and lowest manufacturing cost. However, the external seal ring 40 could be molded integrally with the coaxial barrel plug encapsulation.

Figure 7A:
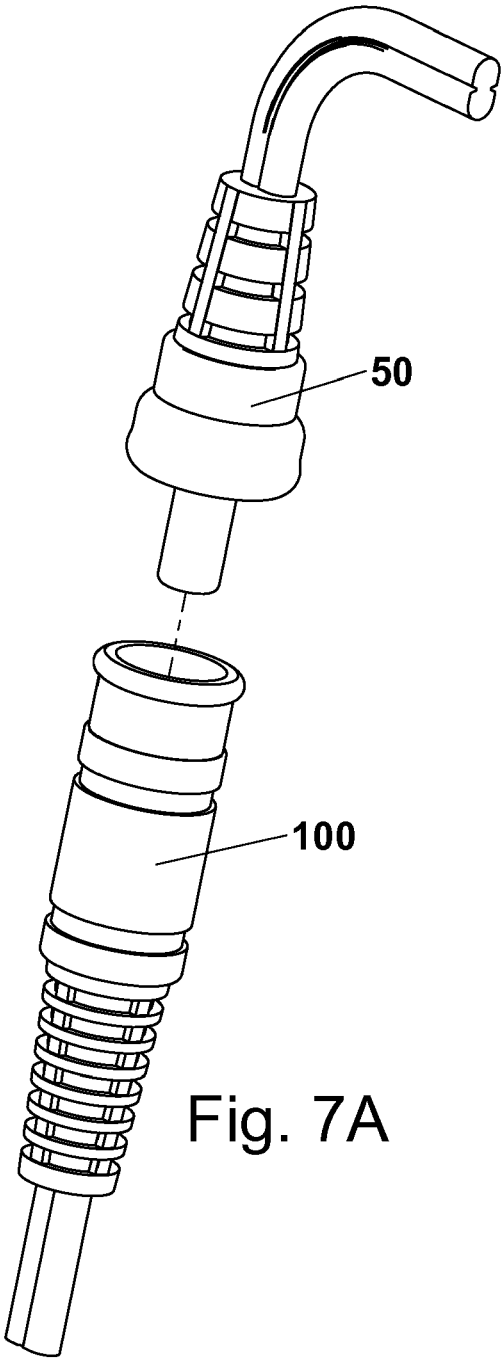
FIGS. 7A and 7B show an exploded view and assembled view of an environmentally protected coaxial barrel plug mated with an environmentally protected coaxial barrel jack. A cutaway in FIG. 7B shows the interface between the mated environmental sealing elements.

FIG. 7A shows an exploded view of an encapsulated coaxial barrel connector set consisting of the environmentally protected coaxial barrel jack 100 and the environmentally protected coaxial barrel plug 50.

Figure 7B:
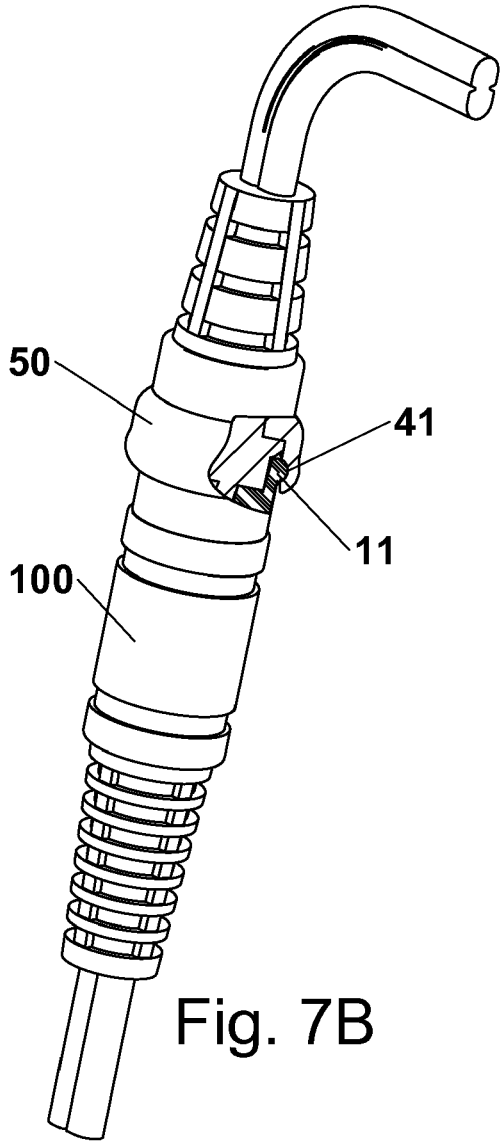

FIG. 7B shows the assembled view of an environmentally protected coaxial barrel connector set consisting of the environmentally protected coaxial barrel jack 100 and the environmentally protected coaxial barrel plug 50. The figure further shows a cut away of the mating area between the environmentally protected coaxial barrel jack and environmentally protected coaxial barrel plug that illustrates how the sealing lip 11 mates with the radial seal groove 41 to form an environmental seal.

Figure 8A:
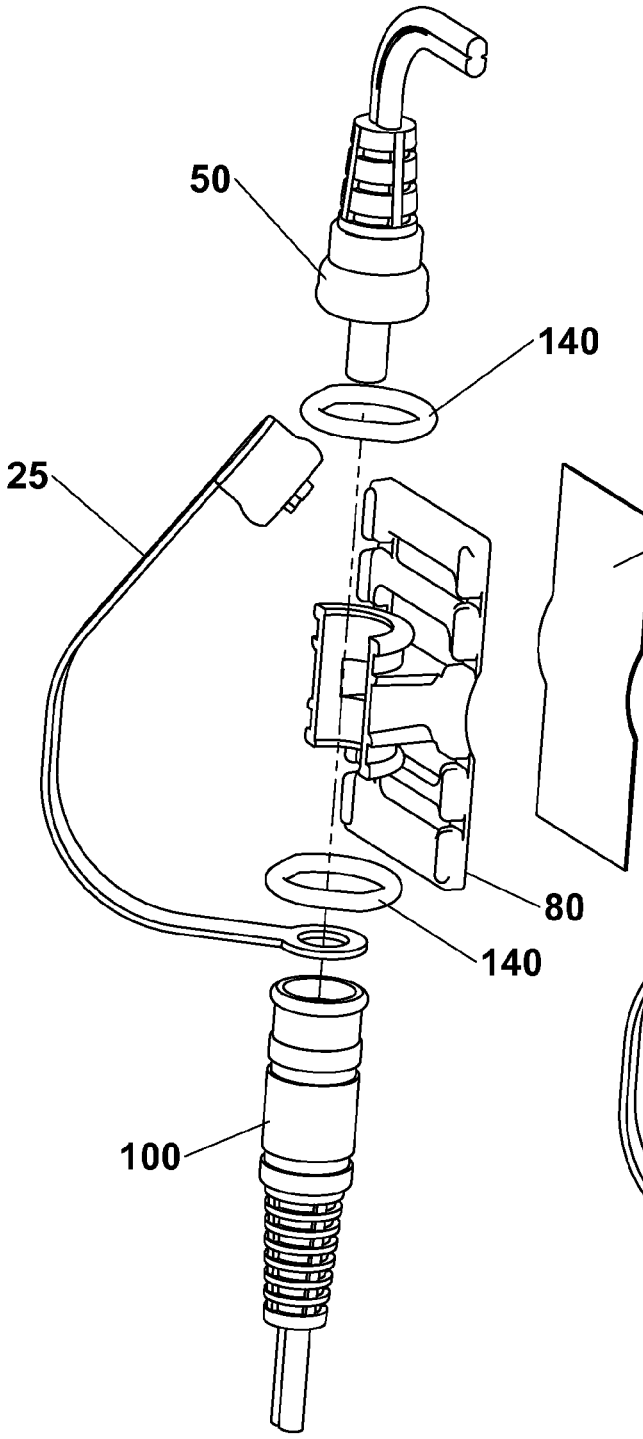
FIGS. 8A and 8B illustrate exploded and assembled views of an environmentally protected coaxial barrel jack, environmental seal cap and mounting bracket.

FIG. 8A shows and exploded view of one embodiment of the parts that make up a mounted environmentally protected coaxial barrel jack 10, mounting bracket 80 and external seal ring 40. As is shown in this embodiment, the assembly may be secured by two o-rings 140 with high performance double stick acrylic tape 141 securing the complete assembly to the vehicle.

Figure 8B:
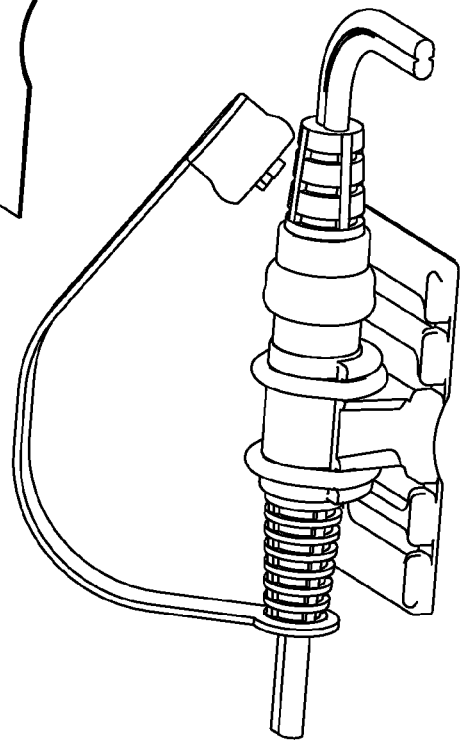

FIG. 8B shows the assembled view of the above embodiment. This view shows how the radial fixing grooves 84 of the saddle element 85 along with the radial grooves 12 of the environmentally protected coaxial barrel jack 100 securely capture the o-rings 140 preventing movement of the environmentally protected coaxial barrel jack 100 with respect to the mounting bracket 80.

Figures 9A, 9B:
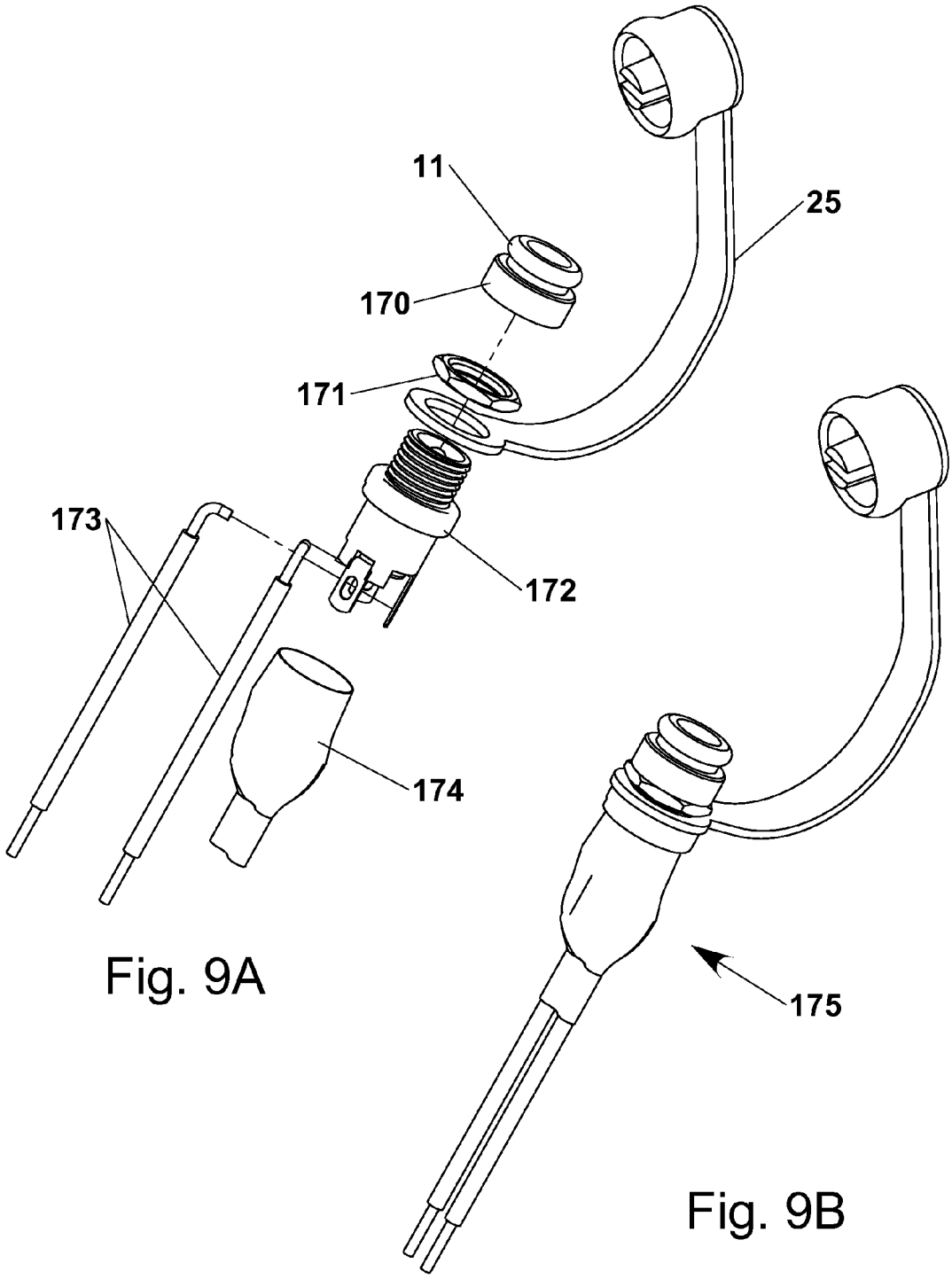
FIGS. 9A and 9B show exploded and assembled views of an embodiment for panel mounting a coaxial barrel connector that is compatible with the environmentally protected coaxial barrel plug. The embodiment shown includes an environmental seal part that mates with the environmental seal part of the environmentally protected coaxial barrel plug. This part may thread onto to the coaxial barrel jack in addition to the normal retaining nut or be used in place of the retaining nut to secure the barrel jack. The figure also illustrates the environmental seal cap and lanyard shown in FIG. 2.

FIGS. 9A and 9B shows an exploded and assembled view of an embodiment of a panel mount coaxial barrel jack 175. Said panel mount coaxial barrel jack includes a standard commercially available coaxial barrel jack 172 to which is soldered the power cables 173 and a covering 174. This covering 174 may be an encapsulation as described for the previous embodiments or common shrink tubing. The panel mount coaxial barrel jack 175 is secured to the vehicle with a panel nut 171 under which is captured the protective cap 25. Lastly an environmental seal nut 170 is secured to the assembly to provide the seal lip 11 to which the environmentally protected coaxial barrel plugs 50 or right angle environmentally protected coaxial barrel plug 60 mates.

Figure 10A:
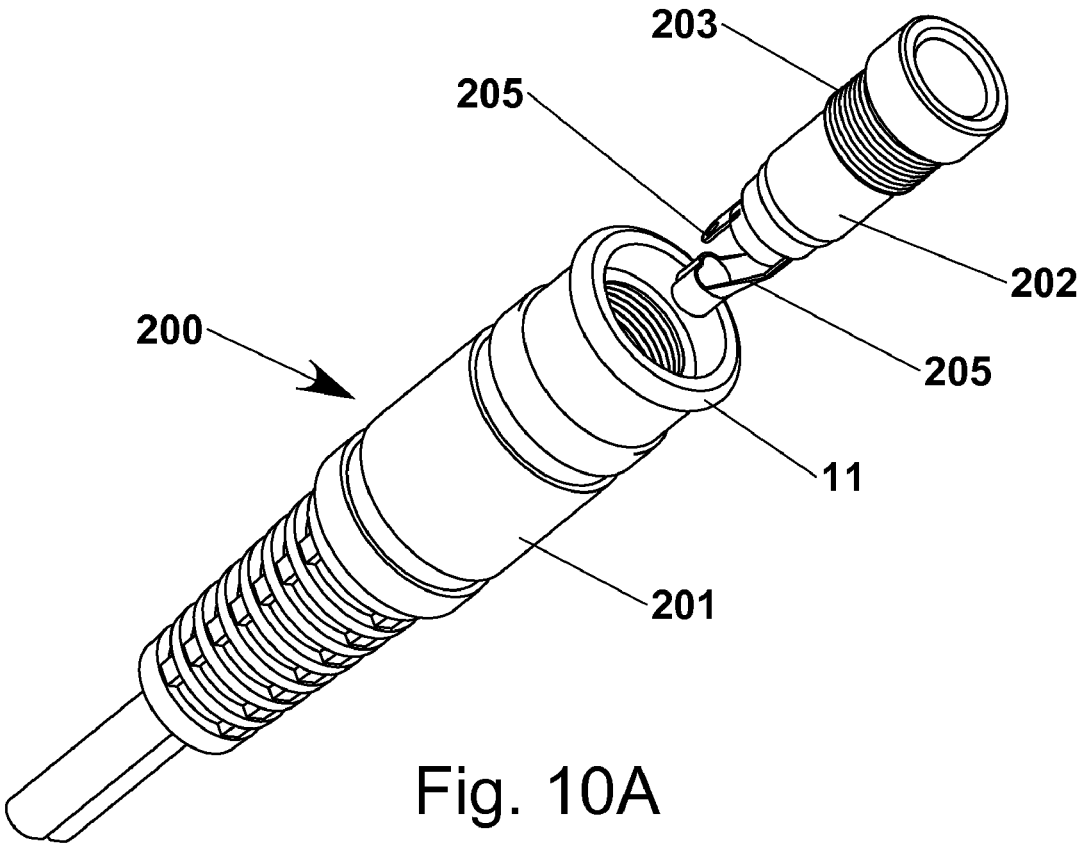
FIGS. 10A and 10B show exploded and assembled views of an environmentally protected coaxial barrel jack embodiment that consists of separable parts that make it suitable for field installation.
Figure 10B:
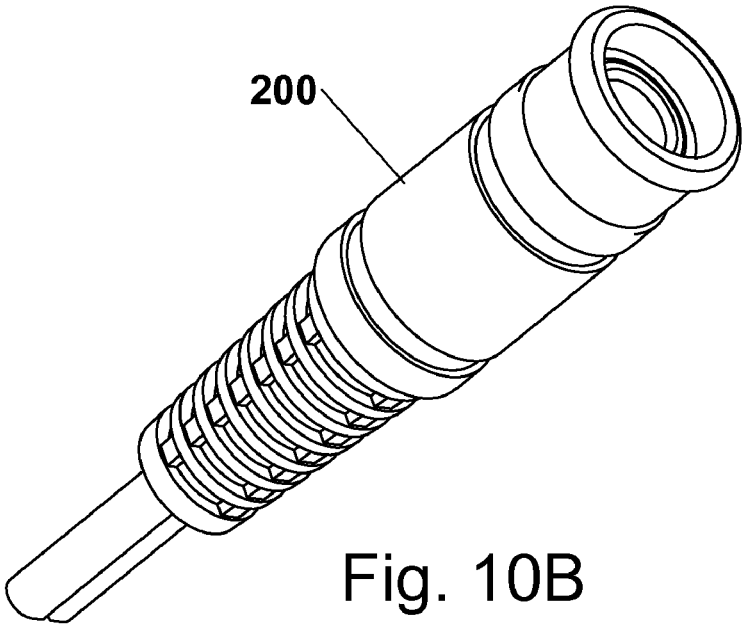

FIG. 10A and 10B shows an exploded and assembled view of an embodiment of a field applied environmentally protected coaxial barrel jack 200. Such an embodiment allows fabrication of wire harnesses in the field using common hand tools. Said field applied environmentally protected coaxial barrel jack 200 consists of a commonly available coaxial barrel jack core 202 with a threaded section 203 on the barrel and solder lugs 205 for wire connections. A threaded coaxial barrel jack encasement 201 has internal threads 204 that allows it to be installed easily onto said field applied environmentally protected coaxial barrel jack 200. Said barrel jack encasement 201 includes a sealing lip 11 located as in coaxial barrel jack encapsulation 10 to provide the sealing function. A similar construction may be employed for the other plug and jack embodiments disclosed herein to allow field installation.

FIG. 20*b* illustrates the assembled field applied environmentally protected coaxial barrel jack 200.

It is evident from the above description, a wide variety of connector configurations may be fashioned from the present invention. Different plug and jack sizes may be encapsulated in a variety of shapes using different materials to meet the needs of differing connection types and vehicle fitments. Accordingly, additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. An integrally molded environmental protective encapsulation covering a coaxial barrel connector female jack and associated wire cable allowing said coaxial barrel connector female jack, normally only suitable for indoor use, to be utilized on outdoor vehicle applications wherein said environmental protective encapsulation is comprised of:

a. said integrally molded environmental protective encapsulation covering said coaxial barrel connector female jack and associated wire cable from a point adjacent to the mating surface of said coaxial barrel jack connector to a point extending past said wire cable, so as to form a single encapsulated part;

b. an integrally molded seal feature separately molded from the encapsulation that covers the female jack and located adjacent to the mating end point of said encapsulation forming a circumferential sealing surface element shaped to conform in a closely fitting male/female manner with a corresponding seal feature of a mating component.

2. An integrally molded environmental protective encapsulation covering a coaxial barrel connector male plug so as to form a single encapsulated part, allowing said coaxial barrel connector male plug, normally only suitable for indoor use, to be utilized on outdoor vehicle applications wherein said environmental protective encapsulation is comprised of:

a. said integrally molded environmental protective encapsulation covering said coaxial barrel connector male plug and associated wire cable from a point adjacent to the mating surface of said coaxial barrel plug connector to a point extending past said wire cable, so as to form a single encapsulated part;

b. an integrally molded external seal element separately molded from the encapsulation that covers the male plug and located adjacent to the mating end point of said encapsulation forming a circumferential sealing surface element inversely shaped so as to conform in a closely fitting male/female manner with a corresponding seal feature of a mating component.

3. The external seal element of claim 2 wherein said external seal element is a separately molded part.

4. A field installable environmental protective housing for externally threaded coaxial barrel connectors with associated wire cable comprising:

a. a molded housing sized to cover said coaxial barrel connector from mating surface to a point extending past said wire cable; an internally threaded element sized to mate with said coaxial barrel jack threads;

b. an integrally molded external seal element separately molded from the molded housing and adjacent to the end of said protecting housing in order fit into a seal element of a mating portion of a corresponding barrel connector.

* * * * *